US006668432B2

(12) United States Patent
Lewis

(10) Patent No.: US 6,668,432 B2
(45) Date of Patent: Dec. 30, 2003

(54) BELT GUIDE FOR CLOTHING ARTICLES

(76) Inventor: Stephani F. Lewis, 13095 Harding Ave., San Martin, CA (US) 95046

( * ) Notice: Subject to any disclaimer, the term of this patent is extended or adjusted under 35 U.S.C. 154(b) by 0 days.

(21) Appl. No.: 10/083,930

(22) Filed: Feb. 26, 2002

(65) Prior Publication Data

US 2003/0159257 A1 Aug. 28, 2003

(51) Int. Cl.[7] ..... A41F 1/00
(52) U.S. Cl. ..... 24/536; 24/516
(58) Field of Search ..... 2/271, 236; 24/536, 24/3.12, 3.6, 494, 495, 498, 513, 515, 516, 547, 570

(56) References Cited

U.S. PATENT DOCUMENTS 668,088 A * 2/1901 Bruce ..... 24/516 X
697,811 A * 4/1902 Conway ..... 24/489 X
1,213,392 A * 1/1917 MaLoney
2,538,509 A * 1/1951 Dorner ..... 24/516 X
3,767,092 A 10/1973 Garrison et al. ..... 223/96
4,463,482 A 8/1984 Hawie ..... 24/489
4,788,723 A * 12/1988 Doelfel ..... 2/271
5,318,174 A 6/1994 Zoroufy ..... 211/45
5,508,682 A 4/1996 Wachsman ..... 340/568
5,573,217 A * 11/1996 Garvey et al. ..... 248/316.7
5,692,673 A 12/1997 De Safey ..... 229/67.2
5,941,450 A 8/1999 De Safey ..... 229/67.2
6,065,563 A * 5/2000 Stowers ..... 181/131

* cited by examiner

*Primary Examiner*—Robert J. Sandy
(74) *Attorney, Agent, or Firm*—Thomas Schneck; Gina McCarthy

(57) ABSTRACT

A device for guiding and preventing the upward movement of a belt worn by a person, the device having a first portion for fastening to a garment, such as a pair of pants or a skirt, and a second cantilevered flange or loop portion extending from an upper portion of the fastener and away from the person, preventing the movement of the belt past the flange or loop portion.

8 Claims, 6 Drawing Sheets

BELT GUIDE FOR CLOTHING ARTICLES

FIELD OF THE INVENTION

The invention relates to a device for holding a belt in place.

BACKGROUND OF THE INVENTION

In the design of women's fashions, one approach is to consider a number of vertically stacked color panels, each panel being like a canvas upon which designs of color and fabric may be assembled. For example, an upper panel would correspond to a space where a blouse may be designed and a lower panel would correspond to a space where a skirt or pants may be designed. An accessory, such as a belt, may unite two such panels. If this is done, then it is important that the belt be held in place in a way that does not detract from the overall optical effect created in the stacked fashion panels. Wide belts can form panels alone, providing optical contrast between upper and lower panels.

Unfortunately, traditional belt loops, while serving well to hold a belt in place, detract from the horizontal sweep of fashion panels. An object of the invention was to devise a substantially invisible belt holder, serving to guide and retain a belt in a desired position between fashion panels yet, which is hardly seen and therefore cannot detract from optical effects between upper and lower fashion panels.

Another object of the invention was to provide a moveable and removable belt guide.

SUMMARY OF THE INVENTION

The above object has been met with a belt guide that clips to articles of clothing, which the belt is worn over and which is hardly visible when clipped. The belt guide has a first portion, which serves as a clip or fastener to the article of clothing and a second portion, which serves to retain the belt in a desired location. The two portions are joined at upper regions, with the second portion being cantilevered outwardly, preventing the belt from moving.

The belt guide may include various types of fasteners to grip and release an article of clothing. The fastening portion of the belt guide may include flaps forming a slot therebetween, the flaps being inwardly biased to securely grip an article of clothing and exhibiting outward flexure to release the article of clothing. In another embodiment, a clamp is positioned to urge flaps inwardly to securely grip the article of clothing and the clamp is removed to release the grip on the article of clothing. In an alternative embodiment, flaps are hinged or pivoted to form and release a secure grip on the article of clothing. A lever may be actuated to position an array of teeth into a slot formed between flaps, and actuated to position the teeth away from the slot. In another embodiment a lever is used to actuate a movable plate into contact with a stationary plate so that the article of clothing can be gripped in between the plates.

The portion of the belt guide that serves to retain the belt in desired locations may comprise a flanged or looped portion extending outwardly from one of the flaps or plates of the chosen fastener.

BEST MODE OF THE INVENTION

Figure 1A:
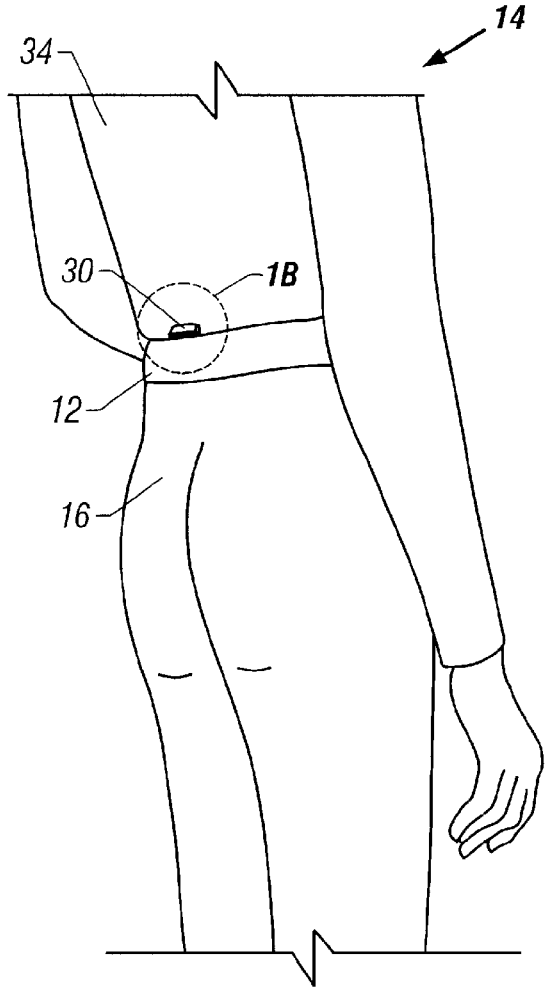
FIG. 1A is a perspective view of the belt guide of the present invention being worn by a person.

With reference to FIG. 1 there is seen a belt guide 10 for guiding and preventing upward movement of a belt 12 worn by a person 14. In one embodiment the belt 12 may be positioned over belt loops (not shown) if present on a pair of pants 16 or other garment worn by the person 14, such as a skirt, which a belt 12 may accessorize.

Figure 1B:
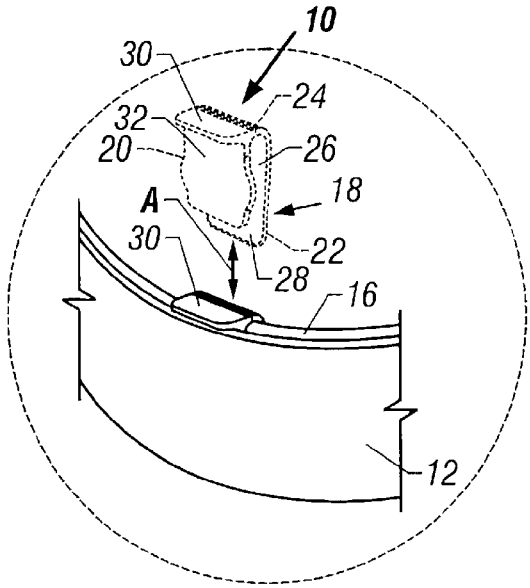
FIG. 1B is a detailed view of an embodiment of the belt guide of FIG. 1A.

The belt guide 10 has a first portion comprising a clip or fastener 18, which serves to clip or fasten the belt guide 10 to garment 16, and more specifically to a portion of pants 16. The fastener 18 may include opposed flaps 20 and 22 connected at an upper end 24 and having mutually facing sides. One of the mutually facing sides, side 26 of flap 22 is seen in FIG. 1B. A slotted opening 28 is formed between flaps 20 and 22 to receive pants 16. The mechanisms by which fasteners having flaps receive and grip garment 16 will be described in further detail below. Other types of fasteners may be utilized in the belt guide 10, as will also be described below.

A second cantilevered portion of the belt guide 10 guides the belt 12 and prevents it from moving upwardly when the fastener 18 attaches to a portion of pants 16. In one embodiment of the belt guide 12, the second portion is a flange portion 30 extending from an upper region 24 or top surface of flap 20. The flange portion 30 is, in one example, made from a stiff material.

The fastener 18 of belt guide 10 is moved in the downward direction as indicated by the downward pointing arrowhead of arrow A to become fastened to pants 16, such that an outside surface 32 of flap 20 remains visible and flange 30 extends away from person 14. The belt 12 is placed over the outside surface 32. Though the belt 12 is not guided by traditional belt loops, the belt 12 is prevented from moving upwardly past the flange portion 30, as the flange portion 30 guides the belt below the flange portion. In one example, the flange portion 30 is cantilevered outwardly to an extent greater than the thickness of the belt 12, preventing the belt 12 from rising. Other types of guiding portions of the belt guide 10 that may be used will be described below. The belt guide is removed, for example by pulling it upward in the direction indicated by the upward pointing arrowhead of arrow A.

The belt 12, the pants 16 and another garment 34, such as a shirt or a blouse above the belt 12, now appear as vertically stacked color panels, each panel being like a canvas upon which designs of color and fabric may be assembled. The belt 12 is held in place in a way that does not detract from the overall optical effect created in the stacked fashion panels as only a small portion of the belt guide 10 is visible. In contrast, the use of traditional belt loops (not shown) for holding a belt in place detracts from the overall optical effect and is therefore, not as fashionable.

The following descriptions are various embodiments of the belt guide 10.

Figure 2:
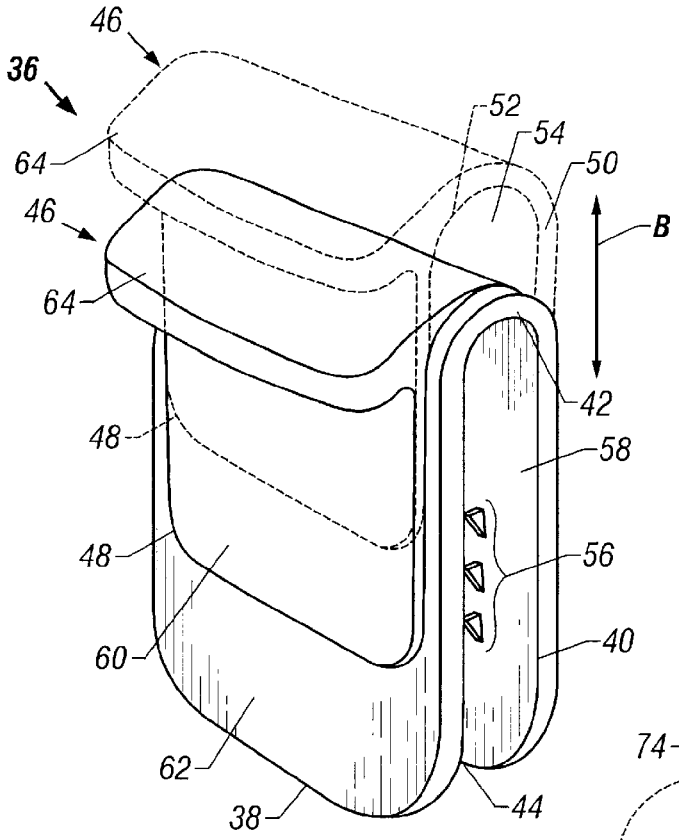
FIG. 2 is a perspective view of an alternative embodiment of the belt guide of FIG. 1.

With regard to FIG. 2 one embodiment of the belt guide of the present invention is seen. Belt guide 36 includes flexible flaps 38 and 40 having mutually facing sides connected at a top end 42 and forming a slotted opening 44 therebetween. A clamp 46 has inwardly biased plates 48 and 50 connected at a top end 52, forming a slotted opening 54. The clamp 46 is placed or slid over the flexible flaps 38 and 40 in the direction indicated by the downward pointing arrowhead of arrow B. The clamp 46 is moved from a position indicated by phantom clamp 46 to the position indicated by non-phantom clamp 46, such that the flaps 38 and 40 or a portion of the flaps are received within the slotted opening 54 of clamp 46 and the top end 52 of the clamp rests upon the top end 42. The biased plates 48 and 50 exhibit outward flexure as the flaps 38 and 40 are inserted within the slotted opening 54. A restoring force of plates 48 and 50 causes the plates to move inwardly, securely urging the flexible flaps 38 and 40 inwardly and holding the flaps, thereby causing the flaps to grip the garment 16. The clamp 46 may be pulled or slid off of the flaps 38 and 40 as indicated by the upward pointing arrowhead of arrow B.

Teeth 56 may be disposed on an inner surface 58 of the flaps 38 and 40 to assist in gripping garment 16. Teeth in other embodiments perform the same or similar function. Outside surface 60 of plate 48 and outside surface 62 of flap 38 remain exposed so that a person may place belt 12 over one or both of them.

In this embodiment, a downward sloping flange portion 64 extends from the top end 52 of clamp 46. As stated with regard to FIG. 1, the flange portion guides the belt 12 below the flange portion 64 and prevents the belt from moving upwardly past the flange portion 64 and outwardly away from the flange and person 14.

Figure 3:
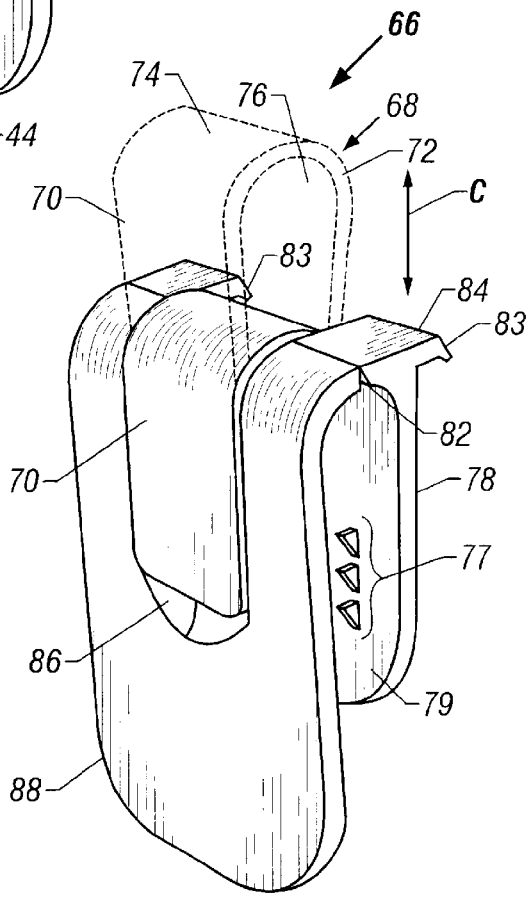
FIG. 3 is a perspective view of an alternative embodiment of the belt guide of FIG. 1.

With regard to FIG. 3 another embodiment of the belt guide of the present invention is seen. Belt guide 66 has a clamp 68 including tangs 70 and 72 inwardly biased, but not as wide as plates 48 and 50 described above. Tangs 70 and 72 are connected at a top end 74 and form a slot 76 therebetween to receive a portion of movable flaps 78 and 80, such as a middle portion. Clamp 68 can be slid downward from the position indicated by phantom clamp 68 to receive the flaps 78 and 80 and upward to remove the flaps as indicated by the upward pointing arrowhead of arrow C. Flaps 78 and 80 are hinged at an upper region 82 of the flaps. Tangs 70 and 72 urge flaps 70 and 78 inwardly as described above with regard to plates 48 and 50, to grip garment 16. Clamp 68 has teeth 77 on an inside surface 79 of flap 78 to assist the flap in gripping garment 16.

Flange portion 84 extends from an upper end of flap 78 and prevents the belt 12 from moving upwardly past the flange. Lip 83 may be included, extending from the flange and preventing the belt 12 from moving outwardly away from the flange and person 14. Belt 12 rests on an outer surface of flap 78, which is not seen. Finger tab 86, indented within flap 80, assists the user in removing the clamp 68 from flaps 78 and 80.

Figure 4A:
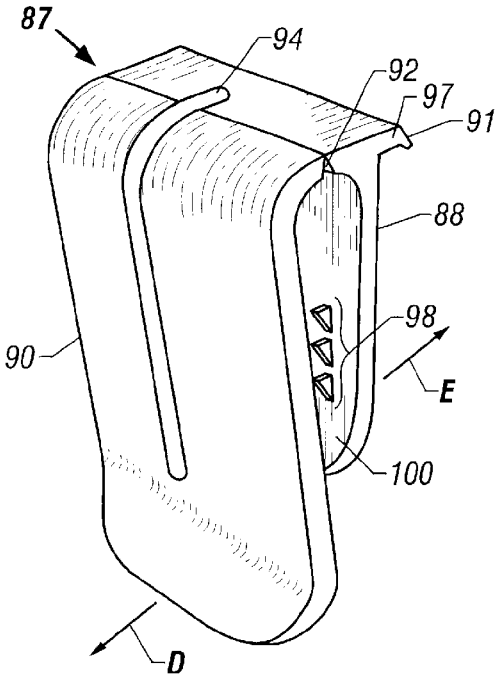
FIG. 4A is a perspective view of an alternative embodiment of the belt guide of FIG. 1 in a closed position.
Figure 4B:
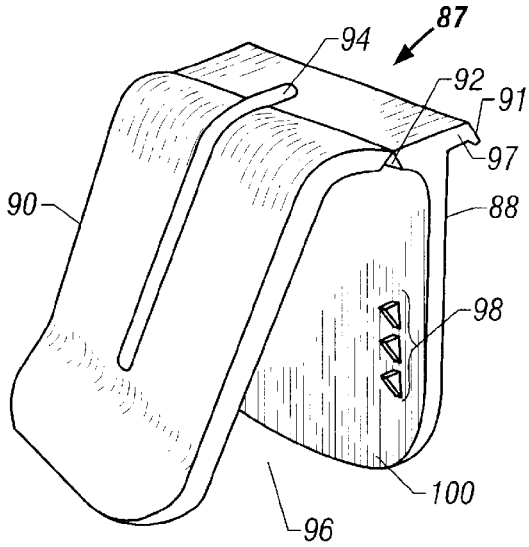
FIG. 4B is a perspective view of the belt guide of FIG. 4A in an open position.

With regard to belt guide 87 seen in FIG. 4, moveable flaps 88 and 90 are seen hinged at an upper region 92. Flaps 88 and 90 are biased inwardly with spring 94 and can be pulled apart as indicated by arrows D and E forming a slot 96 where garment 16 may be received. Flange portion 97 extends outwardly from flap 88 and prevents the belt 12 from moving upwardly past the flange. Lip 91 may be included, extending from flange 97 and preventing belt 12 from moving outwardly away from the flange and person 14. Teeth 98 may be positioned on an inner surface 100 of flap 88. A lower region 99 of flap 90 may be cantilevered outwardly to assist in movement of the flaps 88 and 90.

Figure 5A:
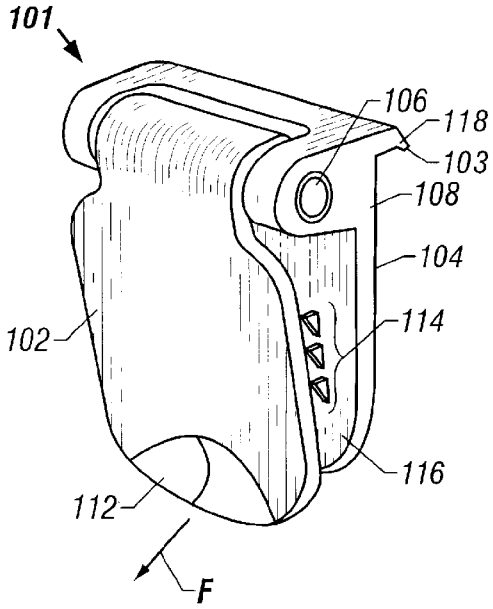
FIG. 5A is a perspective view of an alternative embodiment of the belt guide of FIG. 1 in a closed position.
Figure 5B:
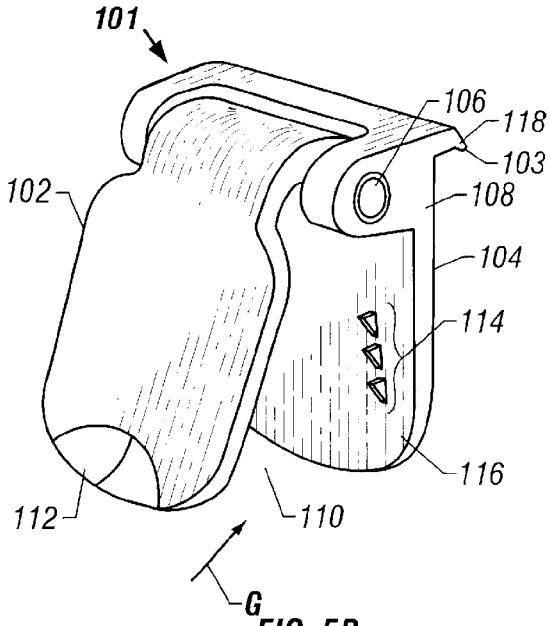
FIG. 5B is a perspective view the belt guide of FIG. 5A in an open position.

With regard to FIG. 5, it is seen that flaps 102 and 104 are connected through a pin 106 in belt guide 101. Pin 106 is disposed through an upper end region 108 of flap 104. Flap 102 is pivotally attached to pin 106. As flap 102 pivots about pin 106, it can be pulled out as indicated by arrow F in FIG. 5A to form slot 110 seen in FIG. 5B to release garment 16. As flap 102 is pushed inwardly, as indicated by arrow G in FIG. 5B, slot 110 is narrowed or closed as seen in FIG. 5A to grip garment 16. Finger tab 112, an indentation on flap 102, may assist the user in pushing or pulling the flap 102. Teeth 114 on inside surface 116 of flap 104 may assist in gripping the garment 16. Flange portion 118 extends from an upper region of flap 104 and prevents the belt 12 from moving upwardly past the flange. Lip 103 may be included, extending from flange 118 and preventing belt 12 from moving outwardly away from the flange and person 14.

Figure 6A:
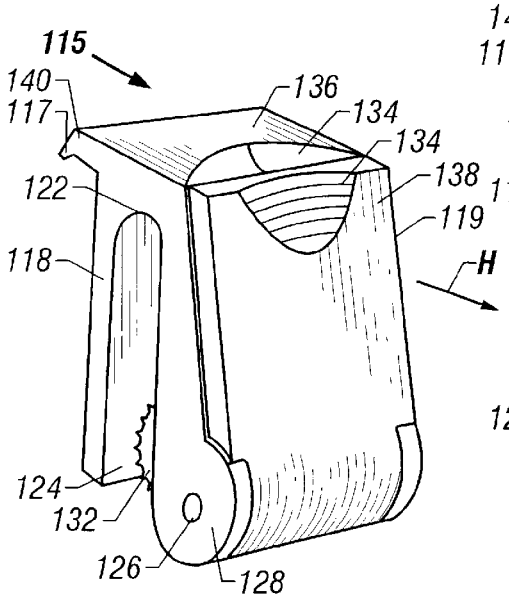
FIG. 6A is a perspective view of an alternative embodiment of the belt guide of FIG. 1 in a closed position.
Figure 6B:
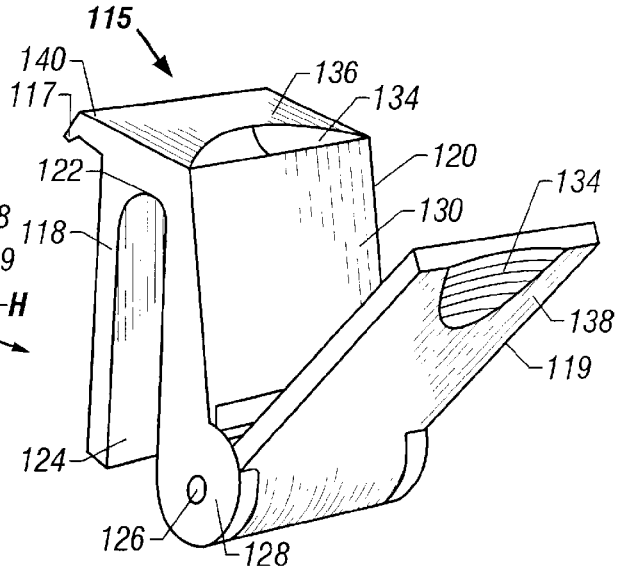
FIG. 6B is a perspective view of the belt guide of FIG. 6A in an open position.

With regard to FIG. 6 it is seen that belt guide 115 features a lever 119 that is actuated to position an array of teeth, for example a wheel of teeth 132, within a slot 124 formed in between flaps 118 and 120 connected at an upper region 122 to grip garment 16, or to an out of slot position to release the garment 16. The lever 119 is connected to the wheel of teeth 132 through a pin 126 disposed through a lower end portion 128 of flap 120. The pin 126 pivotally connects lever 119 to flap 120. Lever 119 is moveable between a contact and a non-contact position with respect to an outer surface 130 of flap 120. When the lever 119 is moved into the contact position, as seen in FIG. 6A, an inner surface of the lever 119 makes contact with the surface 130 and the wheel of teeth 132 are rotated outwardly toward slot 124 and are positioned to grip garment 16. In the non-contact position the lever 119, as shown in FIG. 6B, is pulled away from surface 130 in the direction of arrow H and the wheel of teeth are pulled inwardly to an out of slot position to release the grip on garment 16. Finger tabs 134 positioned on a top surface 136 of the belt guide or a side surface 138 of lever 119 assist the user in gripping the belt guide and in pulling or pushing the lever 119. A flange portion 140 extends from an end of the top surface 136 and prevents the belt 12 from moving upwardly past the flange. Lip 117 may be included, extending from flange 140 and preventing belt 12 from moving outwardly away from the flange and person 14.

Figure 7A:
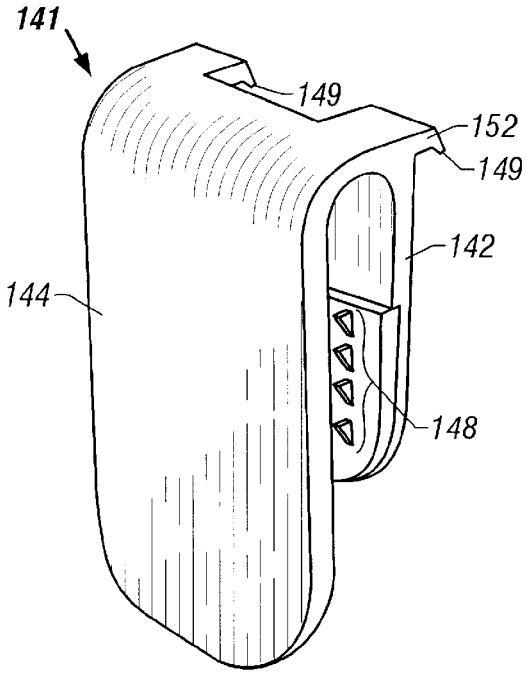
FIG. 7A is a perspective view of an alternative embodiment of the belt guide of FIG. 1.
Figure 7B:
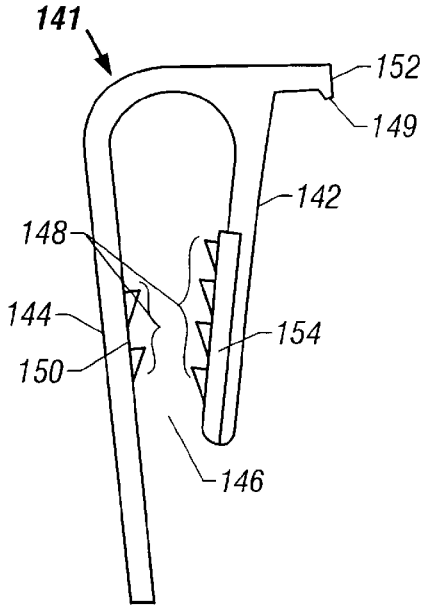
FIG. 7B is a side view of the belt guide of FIG. 7A.

With regard to FIG. 7, belt guide 141 is seen featuring flexible flaps 142 and 144 forming a slotted opening 146 therebetween. The flaps are biased inwardly and are pulled apart to insert garment 16 within the slotted opening 146. The flaps 142 and 144 are dimensioned to exhibit outward flexure when pulled apart. A restoring force of the biased flaps 142 and 144 maintains a secure grip to garment 16, inserted within the slot 146. Teeth 148 are positioned directly on an inner surface 150 of flap 142 or on an insert 154 positioned on the inner surface 150. Flange portion 152 extends outwardly from flap 142 and prevents the belt 12 from moving upwardly past th flange. Lip 149 may be included, extending from flange 152 and preventing belt 12 from moving outwardly away from the flange and person 14.

Figure 8A:
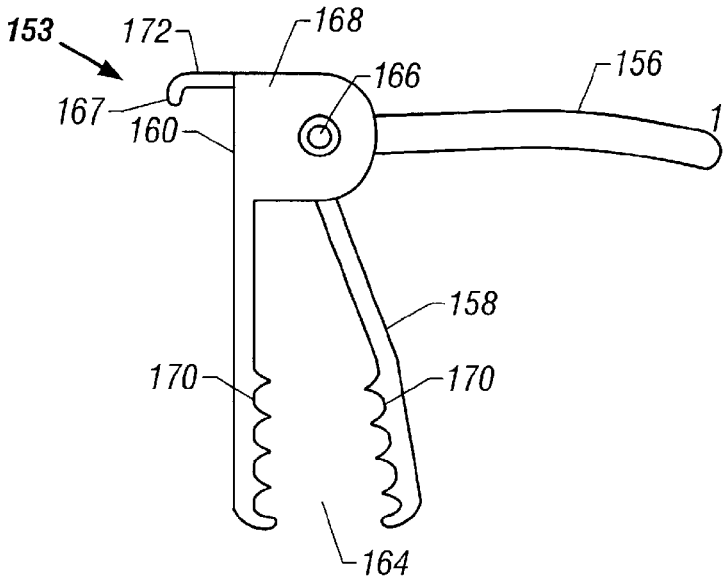
FIG. 8A is a side view of an alternative embodiment of the belt guide of FIG. 1 in an open position.
Figure 8B:
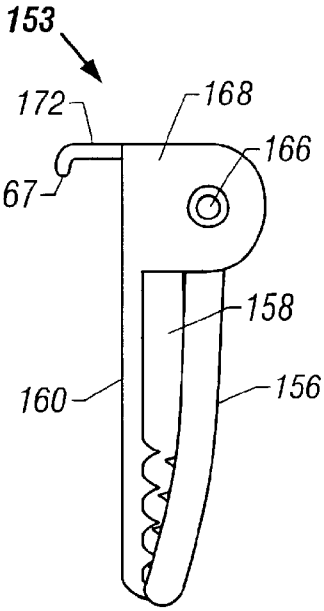
FIG. 8B is a side view of the belt guide of FIG. 8A in a closed position.
Figure 8C:
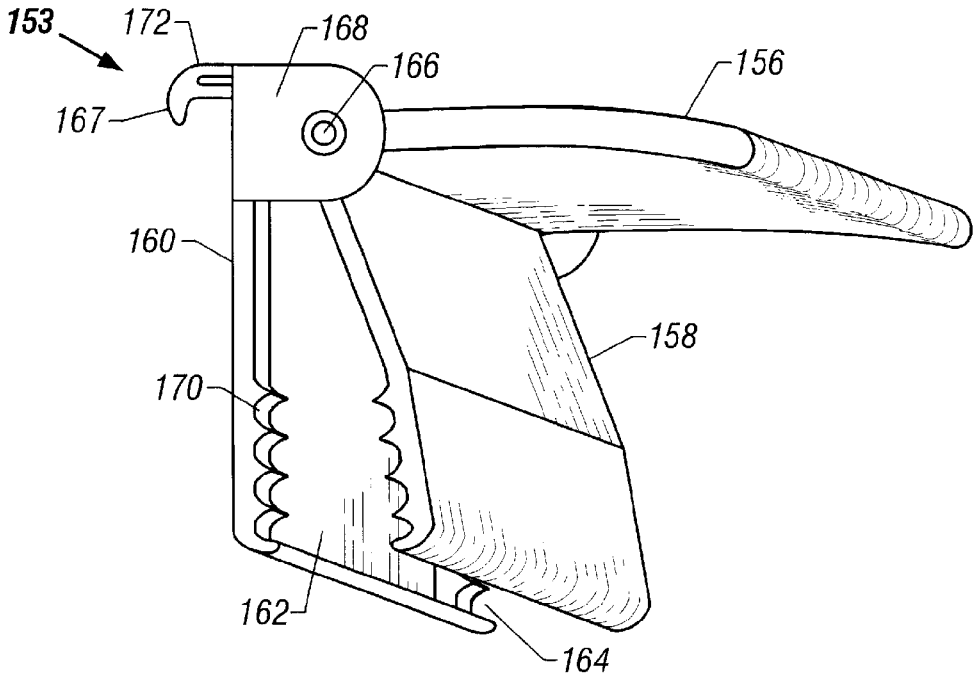
FIG. 8C is a perspective view of the belt guide of FIGS. 8A and 8B.

With reference to FIG. 8, another embodiment of the present invention is seen. Belt guide 153 features a lever 156 actuating a movable plate 158 for engagement with and disengagement from a stationary plate 160. The plates 158 and 160 have mutually facing opposed sides, one of which, side 162 is seen in FIG. 8C. The plate 158 is connected to the stationary plate 160 through a bracket portion 168 connected to a lower portion of stationary plate 160. A slotted opening 164 is formed in between plates 158 and 160. Within the bracket portion 168 is a pivot 166 about which movable plate 158 and lever 156 pivot. Movable plate 158 is connected for engagement with the stationary plate 160 as seen in FIG. 8B for closing the slotted opening 164 and gripping garment 16 therebetween, or for disengagement with the stationary plate 160 as seen in FIGS. 8A and 8C to release garment 16.

When the lever 156 is actuated, it urges movable plate 158 towards stationary plate 160 such that the movable plate engages the stationary plate to securely grip garment 16 therebetween. When the lever is pulled away from the moveable plate 158, moveable plate 158 is disengaged from stationary plate 160 and garment 16 is released. Serrated edges 170 on plates 158 and 160 assist in providing a secure grip to garment 16. The lever 156 and plates 158 and 160, may be as wide or narrow as desired.

A second portion of the belt guide features a loop portion 172 extending away from an upper region of the stationary plate 160. The loop portion 172, as the flange portions described above, guides the belt 12 such that it does not move past the loop portion 172. The loop portion 172 is for example, a ring as seen in FIG. 8. In one example the loop portion is substantially transverse to a longitudinal axis of stationary plate 160. The loop portion 172 may include a lip 167 extending from the loop and preventing the belt 12 from moving outwardly away from the loop and person 14. The loon portion is, for example, metallic.

In one embodiment, the belt guide 153 includes a suspender clip having a clip portion known in the art but a loop portion 172 that is bent such that it prevents the garment 16 from moving upwards.

Figure 9A:
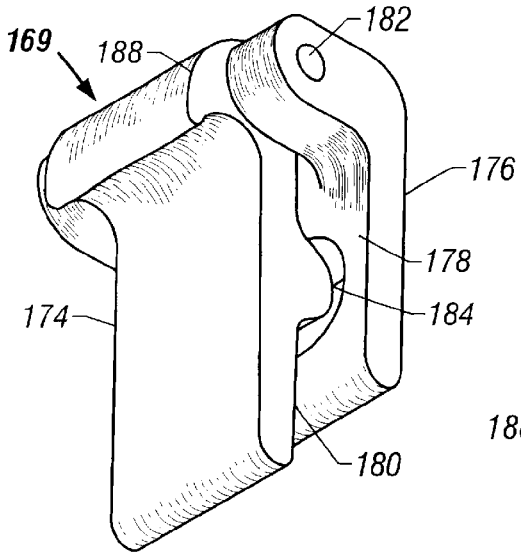
FIG. 9A is a perspective view of an alternative embodiment of the belt guide of FIG. 1 in a closed position.
Figure 9B:
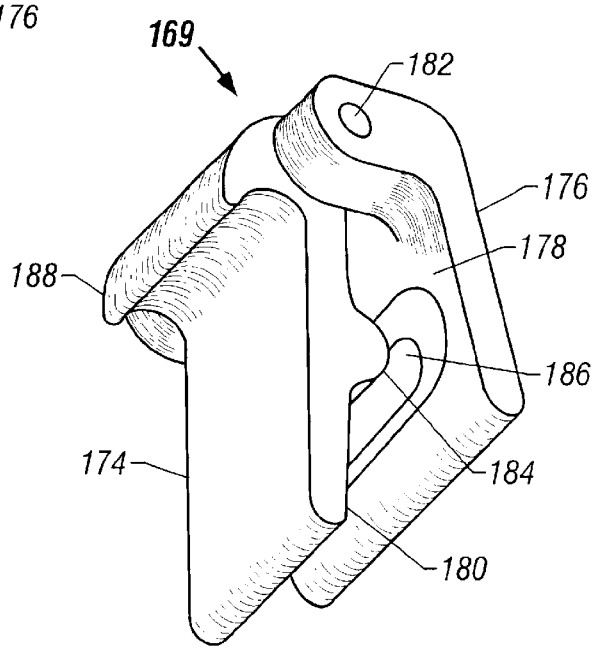
FIG. 9B is a perspective view of the belt guide of FIG. 9 in an open position.

With regard to FIG. 9, belt guide 169 includes opposed flaps 174 and 176 with mutually facing sides 178 and 180. Side 180 includes a flat surface supporting a bump 184 and side 178 includes a flat surface with a recess 186 therein. The recess 186 is in alignment with and has a shape corresponding to the bump 184. The recess 186 is slightly larger in width than the bump 188.

The flaps 174 and 176 are pivotally connected at one end through a pin 182 and are moveable to a closed position (seen in FIG. 9A) to permit the bump 184 to depress garment 16 within the recess 186 to securely grip garment 16 and to an open position (seen in FIG. 9B) to remove the bump 184 from the recess 186 to release the garment. A curved flange portion 188 outwardly extends from flap 174 and prevents upward and outward movement of the belt 12.

Figure 10A:
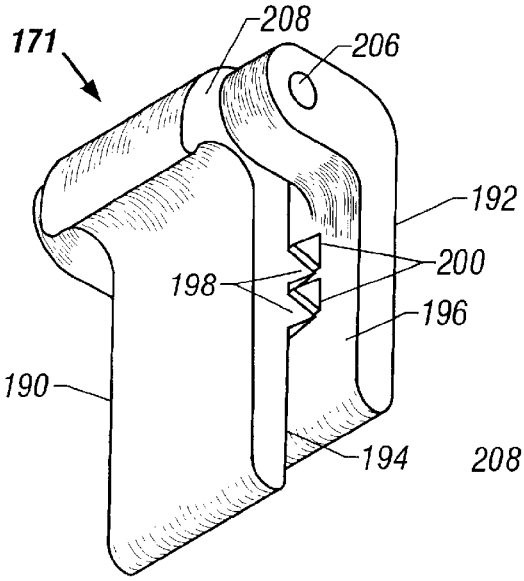
FIG. 10A is a perspective view of an alternative embodiment of the belt guide of FIG. 1 in a closed position.

With reference to FIG. 10, belt guide 171 includes opposed flaps 190 and 192 with mutually facing sides 194 and 196. Side 194 includes a flat surface supporting an array of upper teeth projections 198 and side 196 includes a flat surface with an array of lower teeth projections 200 therein. Between teeth projections 198 is gap 202 and between teeth projections 200 is gap 204. Gap 202 is in alignment with and has a shape corresponding to a tooth projection 198 and gap 204 is in alignment with and has a shape corresponding to a tooth projection 200. The gaps 202 and 204 are slightly wider than the corresponding teeth projections 198 and 200.

Figure 10B:
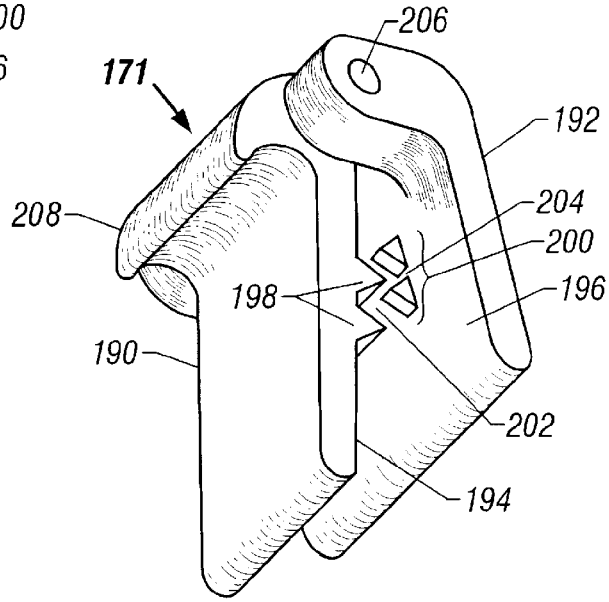
FIG. 10B is a perspective view of the belt guide of FIG. 10A in an open position.

The flaps 190 and 192 are pivotally connected at one end through a pin 206 and are moveable to a closed position (seen in FIG. 10A) to permit meshing engagement between the lower teeth projections 200 and the upper teeth projections 198 and an open position FIG. 10B to permit disengagement of the upper and lower teeth projections. Garment 16 is placed between the teeth projections 198 and 200 and, upon meshing engagement, is gripped by the teeth. Upon disengagement or non-meshing engagement of the teeth the garment 16 is released from the grip. A curved flange portion 208 outwardly extends from flap 190 and prevents upward and outward movement of the belt 12.

The various embodiments of the belt guide of the present invention may include flaps of the same length or size or of varying length or size. Teeth may be present on one or both surfaces of the flap embodiment. The belt guides of the present invention are made, for example, from injection molded plastic, however, other materials may be used.

What is claimed is:

1. A device for preventing upward movement of a belt comprising:

a fastener having a stationary plate connected to a moveable plate, said plates having mutually facing opposed sides and said moveable plate being connected for engagement or disengagement with said stationary plate, and a lever connected to said moveable plate for urging said moveable plate towards and engaging said movable plate with said stationary plate to securely grip therebetween a garment adjacent to a belt worn by a person and disengaging said movable plate from said stationary plate to release said garment, said lever disposed adjacent to said person and a non-facing side of said stationary plate disposed adjacent to a belt worn by said person; and a loop portion extending from an upper region of said stationary plate and away from said person wherein said belt contacts said loop portion guiding said belt below the loop portion thereby preventing said belt from moving upwardly past said loop portion.

2. The device of claim 1 wherein said stationary plate has a top region to which said loop portion mounted.

3. The device of claim 1 wherein said loop portion is metallic.

4. The device of claim 1 further comprising a lip extending from said loop portion.

5. A method for preventing movement of a belt, or the like, worn on a person comprising:

securing a fastener having a cantilevered portion to a garment worn by a person such that said cantilevered portion extends away from said person and a portion of said fastener is positioned outside said garment;

resting a belt on said portion positioned outside said garment;

moving said belt upwardly to said cantilevered portion; and guiding said belt at said cantilevered portion thereby preventing said belt from moving upwardly past said cantilevered portion.

6. The method of claim 5 further comprising said cantilevered portion preventing said belt from moving outwardly.

7. A device for preventing movement of a belt comprising:

a fastener including two plates, one of which is moveable into garment gripping and releasing positions and the other of which is stationary, said garment being adjacent to a belt worn by a person, wherein said moveable plate is movable for engagement and disengagement with said stationary plate; and a cantilevered portion extending outwardly from one of said plates, said cantilevered portion in guidable relation with said belt, guiding said belt below said cantilevered portion upon contact with said belt.

8. A gripping device comprising:

a fastener having a stationary plate connected to a moveable plate, said plates having mutually facing opposed sides and said moveable plate being connected for engagement or disengagement with said stationary plate, and a lever connected to said moveable plate for urging said moveable plate towards and engaging said movable plate with said stationary plate to securely grip a garment therebetween and for disengaging said movable plate from said stationary plate to release said garment; and a loop portion extending from an upper region of said stationary plate.

* * * * *